United States Patent [19]

Bigelow

[11] 4,003,746

[45] Jan. 18, 1977

[54] ORGANIC HETEROCYCLIC AND THIOARYL PHOSPHINES IN SILVER HALIDE EMULSIONS AND DEVELOPERS THEREFOR

[75] Inventor: John Howard Bigelow, Rochester, N.Y.

[73] Assignee: E. I. Du Pont de Nemours and Company, Wilmington, Del.

[22] Filed: July 1, 1975

[21] Appl. No.: 592,262

[52] U.S. Cl. ..... 96/66.3; 96/66 R; 96/66.5; 96/76 R; 96/67; 96/95; 96/107; 96/109

[51] Int. Cl.[2] ..... G03C 5/24; G03C 1/34; G03C 1/06

[58] Field of Search ..... 96/107, 109, 66.3, 66 R, 96/66.5, 95, 76 R, 67

[56] References Cited

UNITED STATES PATENTS

| | | | |
|---|---|---|---|
| 3,297,446 | 1/1967 | Dunn | 96/109 |
| 3,578,449 | 5/1971 | Bloom | 96/66 |
| 3,640,713 | 2/1972 | Buckler et al. | 96/66 |
| 3,644,530 | 2/1972 | Bloom | 260/606.5 |
| 3,785,822 | 1/1974 | Overman | 96/66.3 |
| 3,895,951 | 7/1975 | Riester | 96/109 |

*Primary Examiner*—Won H. Louie, Jr.

[57] ABSTRACT

Photographic elements comprising a silver halide emulsion layer give less fog in negative type emulsions and increased speed in direct-positive emulsions when said emulsions are developed in the presence of an organic heterocyclic or thioaryl-substituted tertiary phosphine.

9 Claims, No Drawings

ORGANIC HETEROCYCLIC AND THIOARYL PHOSPHINES IN SILVER HALIDE EMULSIONS AND DEVELOPERS THEREFOR

BACKGROUND OF THE INVENTION

1. Field of the Invention

This invention relates to photographic silver halide elements of the negative and direct positive types having improved sensitometric characteristics when developed in the presence of a heterocyclic-substituted or a thioaryl substituted tertiary phosphine.

2. Description of the Prior Art

Various prior art patents teach the use of phosphorus compounds in photographic emulsions. Cowden et al. U.S. Pat. No. 3,057,721 issued Oct. 9, 1962, teach photographic emulsions containing tanning and non-tanning developers and trialkyl phosphite and a monocyclic triaryl phosphite of the benzene series.

Dunn, U.S. Pat. No. 3,297,446 issued Jan. 10, 1967, claims a photographic silver halide emulsion sensitized with a noble metal sensitizer and a labile selenium sensitizer, said emulsion containing an antifoggant amount of an organic tertiary phosphine. No heterocyclic or thioaryl phosphines are disclosed.

Thurston, U.S. Pat. No. 3,338,712 issued Aug. 29, 1967, claims a sulfur sensitized emulsion containing from 5 to 500 mg. of trialkoxy and triaryloxy phosphite.

Dunn, U.S. Pat. No. 3,442,653 issued May 6, 1969, teaches the use of reducing agents, triphenyl phosphine being one, to convert selenium in situ to the labile state for sensitizing photographic silver halide emulsions.

Bloom, U.S. Pat. No. 3,578,449 issued May 11, 1971 teaches the incorporation of organic phosphine in photographic processing compositions for use in silver diffusion techniques. No heterocyclic or thioaryl substituted tertiary phosphine is shown.

Bloom, U.S. Pat. No. 3,594,169 issued July 20. 1971, discloses the use of water-soluble tertiary aliphatic phosphines as silver halide solvents in photographic processing compositions having a pH in the range of 4 to 9 for carrying out diffusion transfer processes.

Buckler et al., U.S. Pat. No. 3,640,713 issued Feb. 8, 1972, discloses hydroxyl and/or amine substituted tertiary organic phosphines for use in photographic processing compositions for carrying out diffusion transfer photographic techniques.

Bloom, U.S. Pat. No. 3,644,530 issued Feb. 22, 1972, discloses the preparation of (2,5-dihydroxyphenyl) diphenyl phosphines and discloses that they may be used as sequestering agents, as antifoggants, and as surfacants.

Pollet et al., U.S. Pat. No. 3,681,078 issued Aug. 1, 1972, discloses as antifoggants for silver halide emulsions, compounds represented by the formula R—Se—Q wherein R stands for alkyl, aralkyl, or aryl which may be substituted by halogen, sulfo, carboxyl or nitro or form part of a heterocyclic ring, and Q stands for halogen, cyano, or $PR_3^+X^-$ wherein each R independently stands for alkyl, aralkyl or aryl and $X^-$ stands for an anion but does not exist when R itself contains an anionic group.

Florens et al., U.S. Pat. No. 3,717,466 issued Feb. 20, 1973 claims direct positive silver halide elements which have been uniformly fogged by radiation or chemically with a reducing agent and containing as a sensitizer a selenium compound corresponding to the following formula: R—Se—Q wherein R stands for an alkyl group, an aralkyl group, an alkaryl group, an aryl group or a heterocycle. Q stands for —Se —$R^1$ or — S — $R^1$ stands for alkyl, aryl, aralkyl, alkaryl, heterocyclic, halogen, —CN or $PR_3^+X^-$ where each R independently stands for alkyl, aralkyl or aryl and $X^-$ stands for an anionic group.

The prior art does not, however, teach the use of a heterocyclic or thioaryl phosphine in or for the development of a negative or direct positive type silver halide emulsion.

SUMMARY OF THE INVENTION

The invention relates to a light-sensitive, silver halide, photographic material comprising a support bearing a layer of a silver halide emulsion of the negative or direct positive type containing in the layer or in a contiguous layer a tertiary phosphine having at least one organic heterocyclic or thioaryl group. By negative type silver halide emulsion is meant one wherein by exposure a latent image is formed in the exposed areas, and chemical development produces an image in the exposed areas. A direct positive type silver halide emulsion means one wherein the silver halide grains are fogged by exposure or, preferably, by a chemical fogging agent, e.g. formaldehyde, amine boranes, hydrazine, etc., and which, upon exposure and chemical development, produces an image in the unexposed areas. The invention also provides for incorporating the tertiary phosphine compound in the developer to act as a restrainer. The tertiary phosphine compounds can be represented by the general formula $PR_3$ wherein at least one R is one of the groups:

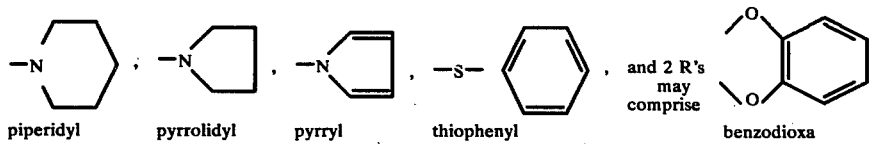

and any other R's are independently selected from alkyl, alkoxy, aryl, aryloxy, and aralkyl.

DESCRIPTION OF THE PREFERRED EMBODIMENTS

In the preferred embodiment, the heterocyclic or thioarylphosphine compounds are incorporated into the silver halide emulsion layers of the light-sensitive material. The way in which the compounds are added to the emulsions is not critical, and the addition can be made during any stage of preparation, i.e., during precipitation of the silver halides, during ripening, during the redispersion step after washing to remove water-soluble silver salts, during digestion, or as a final addition just prior to coating. They may also be incorporated in a layer contiguous with said emulsion layer or in the developer bath used for processing the photographic material. The heterocyclic and thioarylphosphines may be incorporated in any type of light-sensitive material comprising a silver halide emulsion layer e.g., a spectrally sensitized or nonsensitized silver halide emulsion layer, radiographic emulsion layers as well as in high speed negative and positive materials. The amount of heterocyclic or thioarylphosphine compound employed in the ligh-sensitive silver halide material will depend upon the particular type of emulsion and the desired effect and can vary within wide limits. The compounds may be used in antifogging amounts in negative emulsions and as adjuvants increasing Dmax and gradient in direct positive emulsions. The optimum amount to be added can be determined for each emulsion by simple experiment as is customary in the art of emulsion manufacture. Generally, the most suitable concentration will be found to be from 0.005 to 0.5 grams per 1.5 moles of silver halide in the emulsion, although lesser amounts may be used in combination with auxiliary adjuvants. Adjuvants in amounts as low as about $10^{-10}$ grams per 1.5 moles silver halide have previously been found effective in silver halide emulsions. Particularly preferred are 5— or 6-membered organic nitrogen-containing heterocyclic rings and thiophenyl groups for substitution of the teriary phosphines.

Representative heterocyclic and thioarylphosphines are illustrated in the following group:

HETEROCYCLIC AND THIOPHOSPHINES

| Compound No. | Formula & Name |
|---|---|
| 1 | 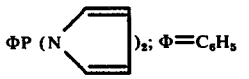 dipyrryl-1-phenyl phosphine |
| 2 | 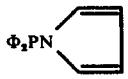 diphenyl-1-pyrryl phosphine |
| 3 | 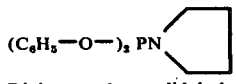 Diphenoxy-1-pyrrolidyl phosphine |
| 4 | 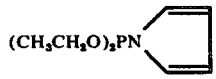 diethoxy-1-pyrryl phosphine |
| 5 | 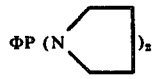 dipyrrolidyl-1-phenyl phosphine |
| 6 | 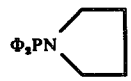 diphenyl-1-pyrrolidyl phosphine |
| 7 | 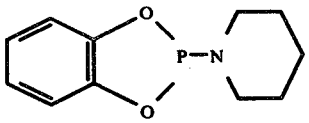 2(1-piperidyl)-1,3,2-benzodioxa phosphine |

-continued

HETEROCYCLIC AND THIOPHOSPHINES

| Compound No. | Formula & Name |
|---|---|
| 8 | $\Phi_2PS—C_6H_5$ diphenyl-1-thiophenyl phosphine |

The tertiary phosphines of the invention may be incorporated in silver halide developer solutions as restrainers. As described in U.S. Pat. No. 3,785,822, restrainers may be used in the range of 0.0005 to 1.0 gram per liter of developing solution. A range of 0.01 to 0.3 is particularly preferred. Silver halide developers are well known in the art and contain a silver halide developing agent such as hydroquinone and its derivatives (e.g. methyl-hydroquinone), catechol, pyrogallol, and the like. Usually a pH such as pH > 8 is employed.

A tertiary phosphine of the invention wherever mentioned herein includes mixtures of various tertiary phosphines. Likewise, the silver halide emulsion layer of the photographic material of the invention includes a plurality of emulsion layers. The silver halide emulsion layer is coated on a support, such as glass, paper, or polymeric film (e.g., a polyester film).

The light-sensitive silver halide emulsions may be chemically sensitized with noble metal salts and labile sulfur, e.g., gold chloride and sodium thiosulfate, etc. Other addenda such as hardeners, wetting agents and plasticizers may be added in the usual way. The restrainers of this invention may be used in conjunction with antifoggants or other known stabilizers, e.g. azaindolizines (tetraazaindenes).

The silver halide crystals may be any of the usual types such as silver chloride, silver bromide, silver bromochloride, silver iodobromide, etc. Particularly useful results have been obtained with lithographic films containing silver bromochloride crystals. Gelatin is the preferred binder for the silver halide crystals, but it may be replaced partially with other material or synthetic binders as is known in the art. Thus, binders used to increase covering power, e.g., dextran, dextrin, polyvinyl pyrrolidone, etc., as well as latices of polymers such as polyethyl acrylate which are useful in improving dimensional stability are advantageously included in many types of silver halide emulsions used in the invention. The latices of polymers are particularly ueful in lithographic films as taught by U.S. Pat. No. 3,142,568 and U.S. Pat. No. 3,305,286.

The invention will now be illustrated by the following examples.

EXAMPLE I

Lithographic films comprising a silver halide emulsion layer containing 30% silver bromide and 70% silver chloride and made in a conventional manner were exposed to a $\sqrt{2}$ optical density wedge plus a 100 line square dot screen at 32 meter-candle-seconds and tray developed for 2 minutes at 80° F in a commercial, high contrast, hydroquinone formaldehyde-bisulfite developer.

To different portions of the developer there were added the quantities of the phosphines identified in the table below by numbers from the group above.

TABLE I

| Compounds and Quantities/ Liter of Developer | Dmin | Dmax | Relative Speed (at Dens. = 3.5 | Gradient Density = 0.3 to 3.5 |
|---|---|---|---|---|
| Control - none | .03 | 5.8 | 100 | 7.33 |
| 0.281 g of compd. 7 | .03 | 5.8 | 100 | 8.93 |
| 0.590 g of compd. 5 | .03 | 5.8 | 50 | 17.3 |
| 0.0118 g of compd. 5 | .03 | 5.8 | 100 | 10.4 |
| 0.287 g of compd. 3 | .04 | 5.8 | 122 | 7.9 |
| 0.287 g of compd. 4 | .04 | 5.8 | 92 | 8.3 |

The data indicate that organophosphines can improve gradient without appreciably changing other characteristics. Speed can be impaired if too much of the organophosphine compound is used.

EXAMPLE II

To an acidified solution of gelatin containing 1.5 moles of KC1 and 0.3 gram of diphenyl-1-this-phenyl phosphine there was rapidly added 1.5 moles of silver nitrate in aqueous solution. There was then added 0.6 moles of aqueous KBr solution and the mixture allowed to ripen for 10 minutes, after which there was added 0.9 moles of aqueous KBr solution and the mixture allowed to ripen for 10 minutes, all at 160° F. The resulting emulsion was cooled, coagulated, washed and redispersed in the manner disclosed in U.S. Pat. No. 2,772,165. The emulsion was divided into two portions, one being used as a control, and to the other there was added 0.3 grams per 1.5 moles of silver halide of compound 8 above. In addition, the emulsion was sensitized with conventional gold and sulfur compounds and digested for 60 minutes at 125° F. to give a negative emulsion.

After coating and drying, the emulsions were exposed in a sensitometer through a $\sqrt{2}$ optical density step wedge with actimic radiation equivalent to 4470 meter-candle-seconds and developed for 2 minutes at 68° F., in a conventional metol-hydroquinone developer and fixed, washed and dried. Sensitometric data are shown in the following table.

TABLE II

| Ctg. No. | Additive | Gradient D = 0.2 to 0.66 | relative | D = 0.3 to 0.66 | relative |
|---|---|---|---|---|---|
| 1 | Control-none | .183 | 1X | .151 | 1X |
| 2 | 0.3g cpd 8 | .26 | 1.42X | .41 | 2.61X |

The gradient is improved with cpd. 8 present regardless of the density range used to calculate.

EXAMPLE III

A direct positive emulsion was made in the following manner. To an aqueous, acidified gelatin solution containing 1.5 moles of potassium chloride and 0.3 gram of compound 2 above there was rapidly added 1.5 moles of silver nitrate in aqueous solution. There was then added 0.6 mole of aqueous potassium bromide solution and the mixture was allowed to ripen for 10 minutes, after which there was added 0.9 mole of aqueous potassium bromide solution and the mixture was allowed to ripen for an additional 10 minutes, all at 160° F. The resulting emulsion was cooled, coagulated, washed and redispersed in the manner disclosed in U.S. Pat. No. 2,772,165. After redispersion there were added 124 grams of gelatin per 1.5 moles of silver nitrate together with $2.4 \times 10^{-6}$ mole of cesium thiaborane as described in U.S. Pat. No. 3,637,392 as a chemical fogging agent. The temperature was raised to 130° F. and the pH was adjusted to 8 with borax and the mixture was digested for 40 minutes at 130° F. The pH was then adjusted to 5.5, coating aids and a gelatin hardener were added, and the emulsion was coated on a photographic type film base and dried. A similar emulsion was made for use as a control and did not contain 0.3 gram of compound 2 in the gelatin-halide salt solution. Test strips of the emulsions were exposed through a 2 step wedge by means of a quartziodine lamp which provided an exposure of 514 meter-candle-seconds. The strips were processed as described in Example III to give the data in the following Table, wherein "Oven" indicates 7 days' aging at 120° F. and 65% relative humidity.

TABLE III

| Ctg. No. | Additive | Age Test | Dmin | Dmax | Speed (Dens. = 1.0) | Gradient (Density = 0.3 to 1.5) |
|---|---|---|---|---|---|---|
| 1 | None-Control | Fresh | .05 | 1.79 | 100 | 1.93 |
| | | Oven | .05 | 1.75 | 87 | |
| 2 | 0.3g Compd 2 | Fresh | .05 | 2.13 | 341 | 2.54 |
| | | Oven | .05 | 1.93 | 236 | |

EXAMPLE IV

A silver halide emulsion was prepared as described in Example II except that no phosphine compounds were added in the aqueous gelatin-halide salt solutions. After the precipitation, the emulsion was washed and redispersed. After redispersion, bulking gelatin was added and the temperature was raised to 130° F. At this point the emulsion was divided into five portions. One portion was used as a control. To the other four portions, there were added the quantities of various phosphine compounds as indicated in the table below. The emulsions were then digested for 60 minutes. The emulsions were coated and dried and cut into sensitometric strips which were exposed and processed as described in Example II. The results are given in the following table. The strips were exposed and tested fresh and after oven aging.

TABLE IV

| Ctg. No. | Additive per 1.5 mole AgHalide | Test Age | Dmin | Dmax |
|---|---|---|---|---|
| 1 | None-Control | Fresh | .12 | 2.52 |
| | | Oven | .95 | 1.90 |
| 2 | 0.1 g. Compd 2 | Fresh | .03 | 2.30 |
| | | Oven | .15 | 2.59 |
| 3 | 0.2 g. Compd 4 | Fresh | .04 | 2.16 |
| | | Oven | .12 | 2.59 |
| 4 | 0.1 g. Compd 6 | Fresh | .03 | 1.35 |
| | | Oven | .32 | 2.68 |
| 5 | 0.1 g. Compd 8 | Fresh | .03 | 1.75 |
| | | Oven | .09 | 2.71 |

The data show that the phosphine compounds act as antifoggants. The compounds generally cause the Dmax to rise after oven aging rather than fall as is the case with some prior art antifoggants. Similar results were obtained when the phosphine compound 2 was added as a final addition.

EXAMPLE V

Example IV was repeated except that sufficient portions of the emulsion were provided to afford one set wherein the emulsions were digested for 60 minutes and another set wherein the emulsions were digested for 120 minutes at 125° F. at the end of which the compounds indicated in the table below were added and the emulsions were coated as described above. The sensitometric results are shown in the following table.

TABLE V

| Ctg. No. | Additive per 1.5 mole AgHalide | Test Age | Dmin. | Dmax. | Speed Dens. = 1.5 |
|---|---|---|---|---|---|
| | | Digestion Time = 60 Minutes | | | |
| 1 | None-Control | Fresh | .04 | 2.05 | 100 |
| | | Oven | .09 | 2.39 | 85 |
| 2 | 0.1 g. of Compd. 8 | Fresh | .02 | 1.75 | 25 |
| | | Oven | .03 | 1.82 | 25 |
| 3 | 0.1 g. of Compd. 2 | Fresh | .02 | 1.92 | 62 |
| | | Oven | .08 | 1.81 | 41 |
| | | Digestion Time = 120 Minutes | | | |
| 1 | 0.1 g. of Compd. 8 | Fresh | .03 | 1.97 | 49 |
| | | Oven | .02 | 2.08 | 49 |
| 2 | 0.1 g. of Compd. 2 | Fresh | .04 | 2.67 | 97 |
| | | Oven | .05 | 2.51 | 77 |

Antifoggant action is evident even under long digestion periods.

EXAMPLE VI

An emulsion was prepared as described in Example II except that sufficient sulfur sensitizer was added to raise the fog level to higher than normal and to demonstrate that the organophosphine adjuvant restrains this fog. The sensitometric results are shown in the following table, wherein the amount of sulfur sensitizer is expressed relative to the amount in the emulsions of Example II.

TABLE VI

| Ctg. No. | Additives per 1.5 Moles AgHalide: Relative Amt. S Sensitizer | Phosphine | Test Age | Dmin. | Dmax. |
|---|---|---|---|---|---|
| 1 | 1X | None | Fresh | .04 | 2.00 |
| | | | 3 months N.A.* | .14 | 2.58 |
| 2 | 1X | 0.2 g. Compd. 2 | Fresh | .04 | 1.98 |
| | | | 3 months N.A. | .14 | 2.10 |
| 3 | 2X | None | Fresh | .46 | 2.07 |
| | | | 3 months N.A. | .74 | 1.48 |
| 4 | 2X | 0.2 g. Compd 2 | Fresh | .15 | 2.18 |
| | | | 3 months N.A. | .30 | 1.89 |

*Aged 3 months at room temperature.

The data indicate that the organophosphine is able to reduce fog considerably in the presence of a high concentration of sulfur sensitizer.

EXAMPLE VII

A direct positive emulsion was prepared as described in Example III except that the organophosphine compounds indicated in the following table were added as final additions prior to coating. The sensitometric results are set forth in the table below.

TABLE VII

| Ctg. No. | Additive per 1.5 Mole AgHalide | Test Aging | Dmin. | Dmax. | Speed Dens. = 1.0 |
|---|---|---|---|---|---|
| 1 | None-Control | Fresh | .07 | 3.00 | 100 |
| | | Oven | .06 | 2.91 | 122 |
| 2 | 0.2 g. Compd. 1 | Fresh | .09 | 2.93 | 92 |
| | | Oven | .08 | 2.77 | 94 |
| 3 | 0.2 g. Compd 4 | Fresh | .05 | 2.77 | 146 |
| | | Oven | .06 | 2.60 | 140 |
| 4 | 0.2 g. Compd 5 | Fresh | .07 | 2.80 | 133 |
| | | Oven | .07 | 2.77 | 128 |

The data indicate that the organophosphines help stabilize speed on aging. (The control changes to greater speed because it loses density in the toe region of the sensitometric curve.) Change in the H&D curve shape on aging is a measure of stability or lack of stability. A material in which the speed is stable does not have to have the exposure conditions varied throughout its life, an obvious advantage.

EXAMPLE VIII

A silver halide emulsion was prepared as described in Example II with the exception that instead of 0.3 grams per 1.5 moles silver halide of compound 8, there were added smaller amounts of compound 8 as shown in the following table.

TABLE VIII

| Ctg. No. | Additive | Fog: Fresh | Fog: 3 Months | Fog: Oven | Dmax: Fresh | Dmax: 3 Months | Dmax: Oven |
|---|---|---|---|---|---|---|---|
| 1 | Control-None | .04 | .05 | .24 | .80 | 1.18 | 2.37 |
| 2 | 0.1 g. Compd. 8 | .03 | .04 | .04 | .48 | .62 | 2.08 |
| 3 | 0.05 g. Compd. 8 | .03 | .04 | .04 | .43 | .67 | 2.50 |
| 4 | 0.025 g. Compd. 8 | .03 | .04 | .04 | .70 | 1.04 | 2.62 |
| 5 | 0.01 g Compd. 8 | .03 | .04 | .08 | .91 | 1.24 | 2.49 |
| 6 | 0.005 g. Compd. 8 | .03 | .04 | .05 | .81 | 1.14 | 2.62 |

I claim:

1. A light-sensitive silver halide photographic material comprising a support bearing a layer of a silver halide emulsion containing in said layer or in a contiguous layer a tertiary phosphine of the formula $PR_3$ wherein at least one R but not more than 2 R's being the same, is a member of the groups

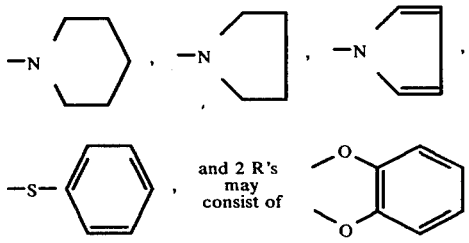

and any remaining one R, or 2 R's being the same, is selected from the group consisting of alkyl, alkoxy, aryl, aryloxy, and aralkyl.

2. The silver halide photographic material of claim 1 wherein one of the R groups is thiophenyl.

3. The silver halide photographic material of claim 1 wherein one R group is selected from the group consisting of piperidyl, pyrrolidyl, pyrryl, and 2 R's may consist of benzodioxa.

4. The silver halide photographic material of claim 1 wherein said phosphine compound is selected from the group consisting of dipyrryl-1-phenyl phosphine, diphenyl-1-pyrryl phosphine, diphenoxy-1-pyrrolidyl phosphine, diethoxy-1-pyrryl phosphine, dipyrrolidyl-1-phenyl phosphine, diphenyl-1-pyrrolidyl phosphine, and diphenyl--thiophenyl phosphine.

5. The silver halide photographic material of claim 4 wherein said tertiary phosphine compound is contained in the silver halide emulsion layer and has a concentration in the range of 0.005 to 0.5 grams per 1.5 moles of silver halide.

6. The silver halide photographic material of claim 1 wherein the silver halide emulsion is a gelatino-silver halide emulsion of the negative or fogged direct positive type.

7. The silver halide photographic material of claim 6 wherein said tertiary phosphine is diphenyl-1-thiphenyl phosphine.

8. A silver halide photographic developer solution which contains at least one silver halide developing agent and a tertiary phosphine of the formula $PR_3$ wherein at least one R, but not more than 2 R's being the same, is a member of the groups

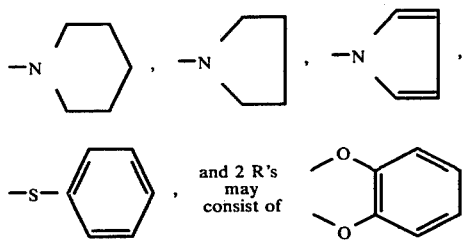

and any remaining R one R or 2 R's being the same is consist of selected from the group consisting of alkyl, alkoxy, aryl, aryloxy, and aralkyl; said tertiary phosphine being present in an amount of 0.01 to 0.3 grams per liter of developer solution.

9. The silver halide photographic developer solution of claim 8 wherein said tertiary phosphine is selected from dipyrryl-1-phenyl phosphine, diphenyl-1-pyrryl phosphine, diphenoxy-1-pyrrolidyl phosphine diethoxy-1-pyrryl phosphine, dipyrrolidyl-1-phenyl phosphine diphenyl-1-pyrrolidyl phosphine, and diphenyl-1-thiophenyl phosphine.

* * * * *

UNITED STATES PATENT OFFICE

CERTIFICATE OF CORRECTION

PATENT NO. : 4,003,746

DATED : January 18, 1977

INVENTOR(S) : John Howard Bigelow

It is certified that error appears in the above-identified patent and that said Letters Patent are hereby corrected as shown below:

| Column | Line | |
|---|---|---|
| 9 | 35 | "diphenyl--thiophenyl" should be -- diphenyl-1-thiophenyl --. |
| 10 | 8 | "diphenyl-1-thiphenyl" should be -- diphenyl-1-thiophenyl --. |
| 10 | 27 | The first occurrence of "R" should be deleted. |
| 10 | 28 | Delete "consist of". |

Signed and Sealed this

Tenth Day of May 1977

[SEAL]

*Attest:*

RUTH C. MASON
*Attesting Officer*

C. MARSHALL DANN
*Commissioner of Patents and Trademarks*